US012179963B2

(12) United States Patent
Selina et al.

(10) Patent No.: US 12,179,963 B2
(45) **Date of Patent: *Dec. 31, 2024**

(54) GASKETLESS CLOSURE FOR OPEN-TOP PAILS

(71) Applicant: Letica Corporation, Rochester Hills, MI (US)

(72) Inventors: John R. Selina, Brighton, MI (US); Christopher Myles Larsen, Farmington Hills, MI (US); Anton Letica, Bloomfield Hills, MI (US); Arthur Habitz, Berkley, MI (US)

(73) Assignee: Letica Corporation, Rochester Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/497,372

(22) Filed: Oct. 8, 2021

(65) Prior Publication Data

US 2022/0024653 A1 Jan. 27, 2022

Related U.S. Application Data

(63) Continuation of application No. 15/919,654, filed on Mar. 13, 2018.

(51) Int. Cl.
*B65D 43/02* (2006.01)

(52) U.S. Cl.
CPC ..... *B65D 43/0208* (2013.01); *B65D 2543/00092* (2013.01); *B65D 2543/00296* (2013.01); *B65D 2543/005* (2013.01); *B65D 2543/00537* (2013.01); *B65D 2543/00555* (2013.01); *B65D 2543/00953* (2013.01)

(58) Field of Classification Search
CPC ..... B65D 43/0208; B65D 41/0428; B65D 2543/00092
See application file for complete search history.

(56) References Cited

U.S. PATENT DOCUMENTS

| | | | | |
|---|---|---|---|---|
| 2,859,786 A | | 11/1958 | Tupper | |
| 3,053,406 A | | 9/1962 | Wandell | |
| 3,255,907 A | * | 6/1966 | Eddy | B65D 41/0428 215/354 |
| 3,802,590 A | | 4/1974 | Culver | |
| 3,817,420 A | | 6/1974 | Heisler | |

(Continued)

*Primary Examiner* — Anthony D Stashick
*Assistant Examiner* — Blaine G Neway
(74) *Attorney, Agent, or Firm* — Barnes & Thornburg LLP

(57) ABSTRACT

A container package includes a container and a lock-on closure that couples to the container. The container includes an annular sidewall. The closure includes a channel portion having an inner, an outer, and a top wall that define a channel. The inner wall includes a primary seal having sealing ridges formed thereon. The closure further includes a single, flexible sealing wiper appendage extending away from the top wall. When the sidewall of the container is outside of the channel, the appendage is in a first position in which it extends downwardly and is angled inwardly so a terminal end of the appendage is freely suspended within the channel. When the sidewall of the container is in the channel, the appendage is in a second position in which the terminal end is closer to the inner wall than in the first position and the appendage contacts the top rim.

21 Claims, 3 Drawing Sheets

(56) References Cited

U.S. PATENT DOCUMENTS

| | | | | | |
|---|---|---|---|---|---|
| 3,948,405 | A | * | 4/1976 | Yonker | B65D 41/0428 215/DIG. 1 |
| 4,248,356 | A | | 2/1981 | McCarthy | |
| 4,380,304 | A | * | 4/1983 | Anderson | B65D 43/0212 215/DIG. 1 |
| 4,442,947 | A | * | 4/1984 | Banich, Sr. | B65D 41/0421 215/DIG. 1 |
| 5,238,135 | A | | 8/1993 | Landis | |
| 6,279,774 | B1 | | 8/2001 | Clute | |
| 6,619,498 | B2 | | 9/2003 | Von Holdt, Jr. | |
| 6,708,839 | B2 | | 3/2004 | Diesterbeck | |
| 7,055,708 | B1 | | 6/2006 | Haffner | |
| 7,207,457 | B2 | | 4/2007 | Schwarz | |
| 7,743,952 | B2 | | 6/2010 | Auer | |
| 7,963,419 | B2 | | 6/2011 | Burney | |
| 8,459,486 | B2 | | 6/2013 | Luburic | |
| 8,863,983 | B2 | | 10/2014 | Meers | |
| 9,051,095 | B2 | | 6/2015 | Antal, Sr. | |
| 2007/0205196 | A1 | | 9/2007 | Burney | |
| 2008/0217338 | A1 | | 9/2008 | Campbell | |

* cited by examiner

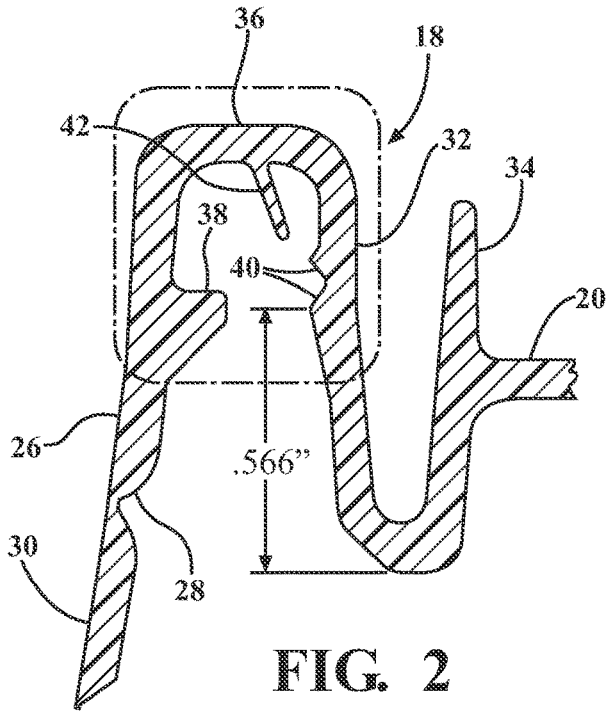
FIG. 2
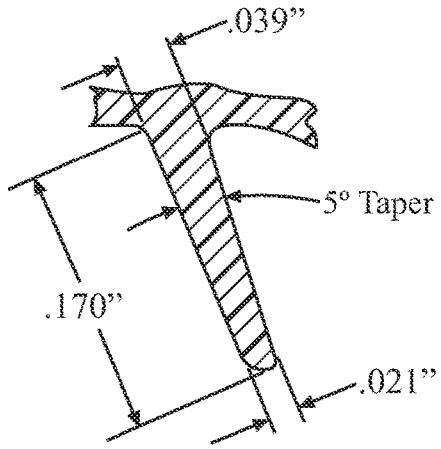
FIG. 4
FIG. 3
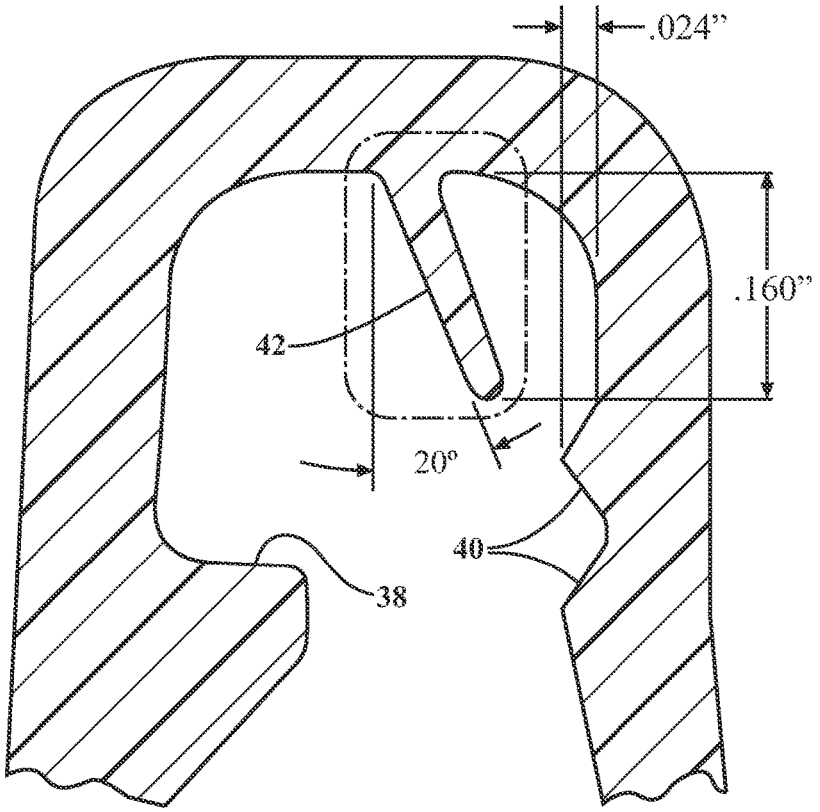

GASKETLESS CLOSURE FOR OPEN-TOP PAILS

PRIORITY CLAIM

This application is a continuation of U.S. application Ser. No. 15/919,654, filed Mar. 13, 2018, which is expressly incorporated by reference herein.

FIELD OF THE INVENTION

This invention relates to closures; i.e., "lids," for open-top pails and, more particularly, to a plug fit closure that provides an effective seal between the closure and the pail without the use of a conventional gasket.

BACKGROUND

Molded plastic closures for open-top pails are in wide spread use and are available from numerous manufacturers including the Letica Corporation of Rochester, Mich. The pails, also called "containers," and closures are generally made from high density polyethylene, hereinafter "HDPE," and are injection molded in a range of capacities from about one to six gallons and may or may not have pouring spouts and bails for carrying. The closures snap or "lock" firmly on the pails and may have various means such as tear bands on an outer skirt to aid in removal from the pail.

Where such pails are used to carry perishable goods or fluids, it is common to design the closure to provide a "plug fit" wherein the pail rim extends into and is trapped between the parallel walls of an inverted U-shaped annular channel formed in the peripheral portion of the closure structure. Conventional wisdom further calls for the use of a resilient gasket which is placed in the top of the channel and against which the top of the inserted pail rim bears to form a seal. An example of such a pail/closure combination is shown in U.S. Pat. No. 7,207,457 issued Apr. 24, 2007 to Stefan Schwarz and assigned to Letica Corporation.

The gasket itself adds to the cost of the product and the placement of the gasket into the channel is a secondary operation that adds still more cost and complexity to the manufacturing process. This presents a competitive disadvantage; moreover, recycling of the closure becomes more complex because of the different materials used to make the closure and the gasket.

As a result, various attempts dating back to at least 1976 have been made to eliminate the gasket while still providing an effective seal. One approach is to manufacture both the closure and the pail to close tolerances to provide a very tight fit and to design the mold to provide a complex and a conforming geometry between the pail rim and the closure. Again, this puts pressure on the design, manufacture, and maintenance of the tooling used to injection mold the HDPE lid and pail. Further, the seals can lose effectiveness due to age and/or damage to the pail rim or the closure channel through ordinary handling.

SUMMARY

According to the present disclosure, a container package includes a container and a lock-on closure configured to couple to the container. The container includes an annular sidewall having an inner annular container wall with a top annular edge, a top rim extending radially outwardly from the top annular edge, and a downwardly extending container wall extending downwardly away from a radially outer end of the top rim.

In illustrative embodiments, the lock-on closure includes a plastic body including an annular peripheral channel portion including an inner annular wall, an outer annular wall, and a top annular wall so as to define an inverted annular U-shaped channel configured to receive lockingly the annular sidewall of the container in a plug fit. The outer annular wall includes an annular ledge extending radially inwardly away from the outer annular wall and configured to abut lockingly an under surface of the downwardly extending container wall in response to the annular sidewall of the container being fully inserted into the inverted annular U-shaped channel. The inner annular wall includes a primary seal for cooperation with the inner annular container wall, the primary seal including a plurality of annular sealing ridges formed on the inner annular wall to lie sealingly against the inner annular container wall to form the primary seal.

In illustrative embodiments, the lock-on closure further includes a single, flexible sealing wiper appendage extending away from an interior facing surface of the top annular wall of the annular peripheral channel portion. In response to the annular sidewall of the container being outside of the inverted annular U-shaped channel, the sealing wiper appendage is in a first position in which the sealing wiper appendage extends downwardly from the top annular wall and is angled radially inwardly toward the inner annular wall and the primary seal such that a terminal end of the sealing wiper appendage is freely suspended within the inverted annular U-shaped channel. In response to the annular sidewall of the container being fully inserted into the inverted annular U-shaped channel, the sealing wiper appendage is in a second position in which the terminal end is closer to the inner annular wall than in the first position and in which the sealing wiper appendage contacts a top outer surface of the top rim to form a secondary seal with the container which secondary seal reacts to pressure within the container to increase in sealing effect.

Additional features of the present disclosure will become apparent to those skilled in the art upon consideration of illustrative embodiments exemplifying the best mode of carrying out the disclosure as presently perceived.

BRIEF DESCRIPTION OF THE DRAWING

FIG. 2 is a sectional view of a portion of the closure showing features of the invention;

FIG. 3 is a dimensioned detail of the closure channel;

FIG. 4 is a dimensional detail of the wiper appendage;

DETAILED DESCRIPTION

Figure 1:
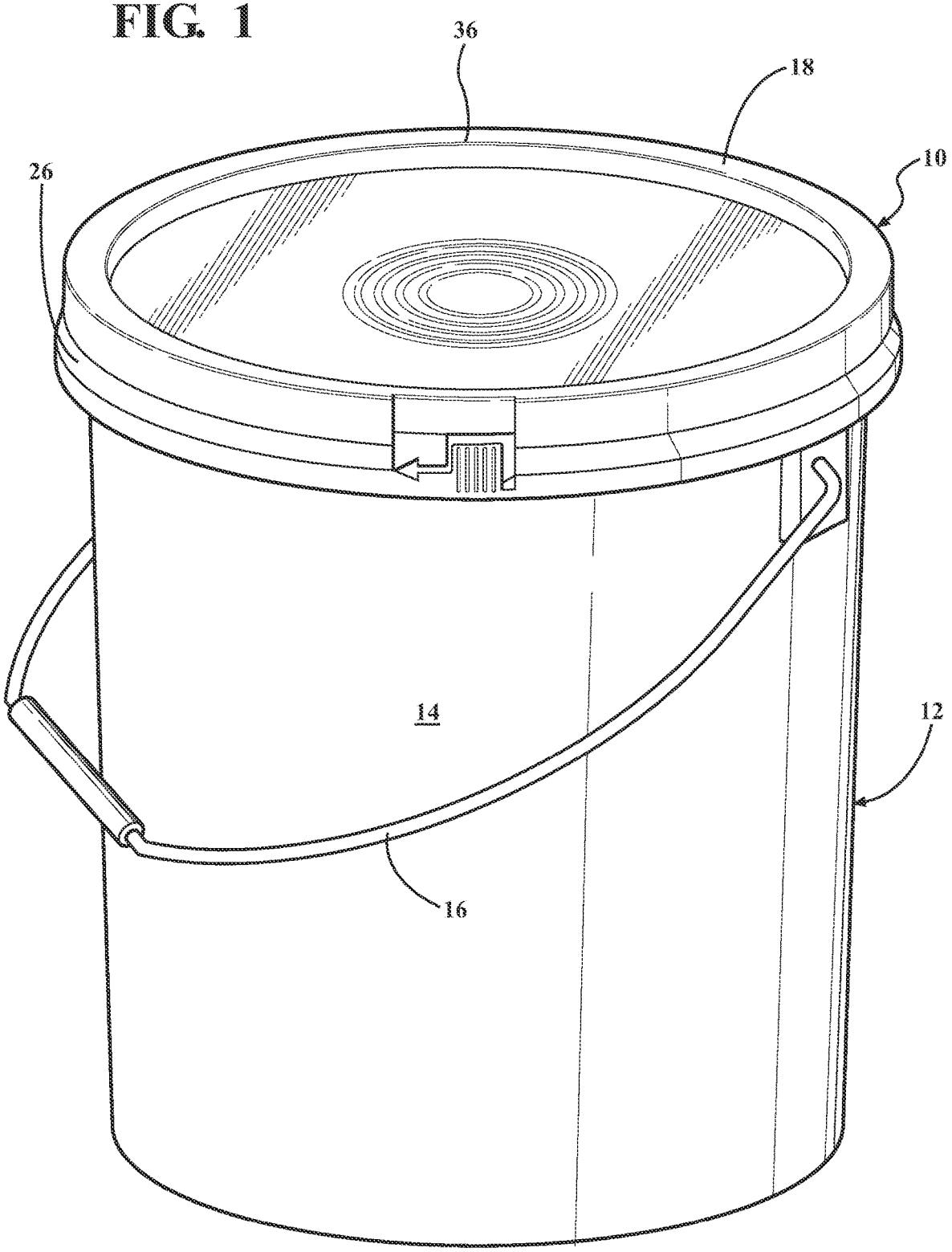
FIG. 1 is an example of a molded plastic closure and pail combination of the type to which the invention can be practically applied.
Figure 5:
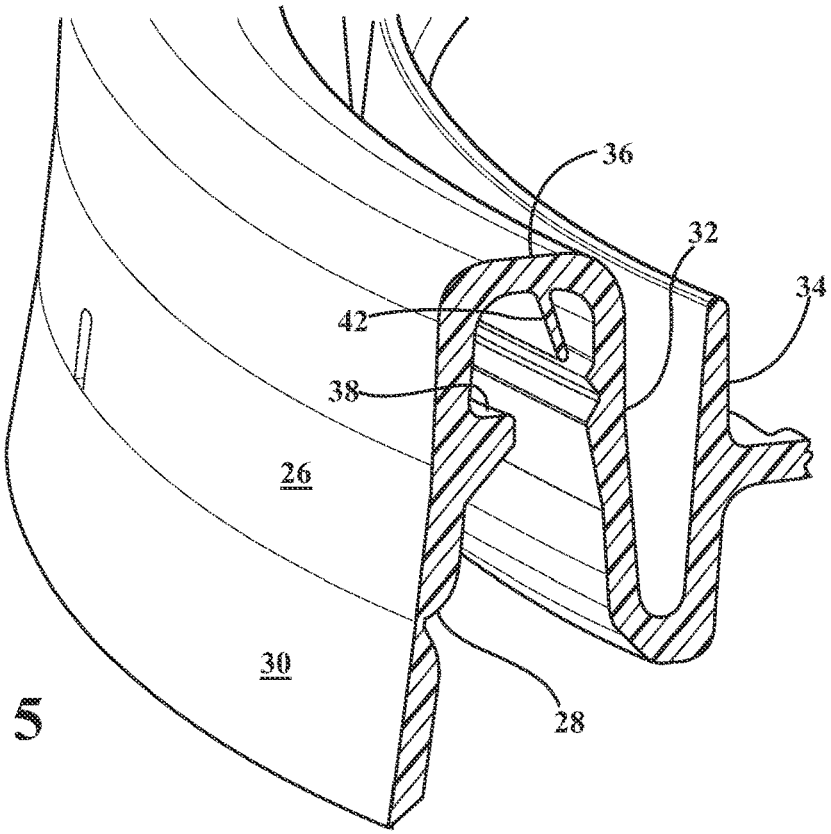
FIG. 5 is a perspective view of a portion of the closure channel.

Referring to FIG. 1 there is shown a molded plastic closure 10 for a five-gallon open-top molded plastic pail 12 having a tapered sidewall 14 and a wire bail 16. Both the closure 10 and the pail 12 are preferably injection molded from HDPE. Other plastics, such as polypropylene, can also be used.

The closure 10 has an annular peripheral channel portion 18 surrounding a generally circular inner deck portion 20 and is sized to fit on the pail 12 in such a way as to "lock" onto the pail and provide a seal to prevent both the ingestion of air into the pail 12 as well as to prevent leakage from any fluid carried by the pail in the fully closed condition. This representation is intended to be generic in nature; i.e., it shows a typical pail/closure configuration wherein the closure has a "plug fit" on the pail rim, and also has a "tear strip" on the outer skirt, details of which are omitted here but can be found in the Schwarz patent identified above, incorporated herein by reference.

Figure 6:
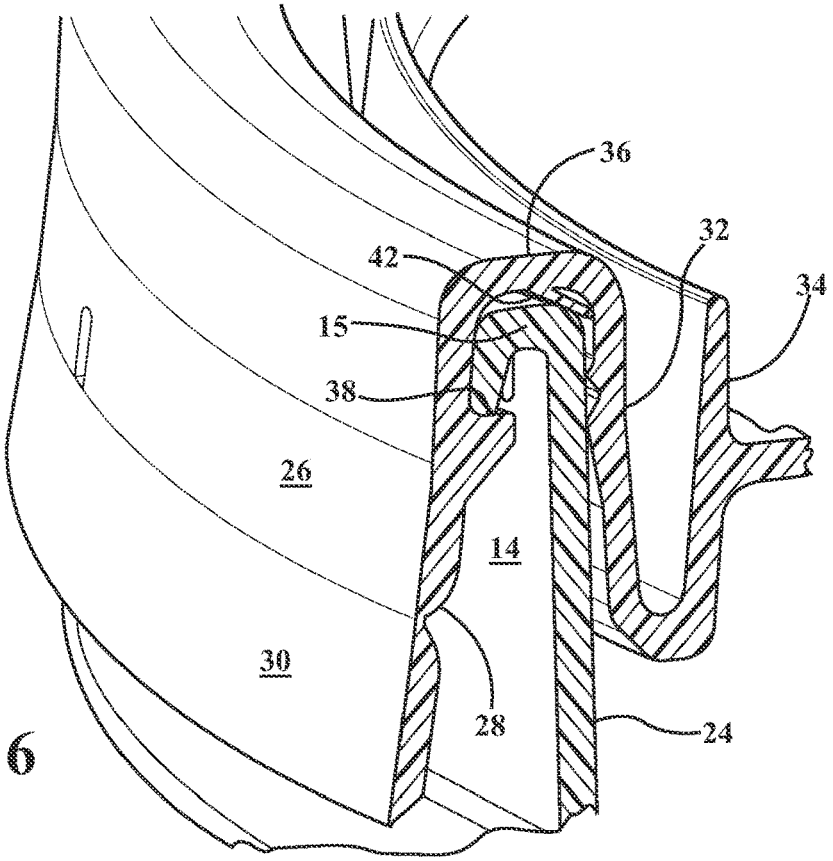
FIG. 6 shows the closure channel with the pail rim inserted and locked in place.

Referring now to FIGS. 2-6, details of the annular peripheral channel portion 18 of the closure 10 are described. As stated above, the pail 12 has a slightly tapering annular sidewall 14 which ends in an annular top rim portion 15 with a generally a flat-top although the edges, both inner and outer, may be radiused. The annular sidewall 14 also includes an inner annular container wall 24 and a downwardly extending container wall 17. The top rim portion 15 is shown in FIG. 6 to have a rolled-over configuration but can also be flat-bottomed. The rolled-over configuration is preferred. The diameter of the rim 15 is about 11.5 inches.

The annular peripheral channel portion 18 of the closure 10 consists of an outer annular wall or "skirt" 26 and an inner annular wall 32 which, together with the top annular wall 36, define an inverted U-shaped channel into which the top rim portion 15 of the pail 12 is inserted as best shown in FIG. 6 to provide a plug fit. This means that, in addition to an outer wall that captures only the outside of the pail rim, the closure has an inner wall that extends down into the container.

The inside surface of the outer wall or skirt portion 26 of the closure 10 is molded with an annular groove 28 which weakens the material to allow the lower portion 30 of the skirt to function as a "tear strip" in conventional fashion. Details of a tear strip structure can be found in the above-described Schwarz patent, incorporated herein by reference. An annular ledge 38 is formed below the top annular wall 36 of the inverted U-shape channel so as to extend radially inwardly away from a radially inwardly facing surface 35 of the outer annular wall 26 to lockingly interact with the undersurface of the downwardly extending container wall 17 of the pail 12 as shown in FIG. 6.

The radially outwardly facing surface 37 of the inner annular wall 32 is molded to provide two vertically spaced continuous, annular sealing ridges 40 that contact the radially inwardly facing surface 25 of the inner annular container wall 24 when sufficiently inserted into the U-shaped channel to provide a primary seal. See FIG. 6.

An inner structure 34 connects the inverted U-shaped channel to the center deck 20 in the manner shown to provide for stacking stability if desired.

The interior facing surface 41 of the top wall 36 of the annular peripheral channel portion 18 has molded thereon a single, circularly, continuous, flexible sealing wiper appendage 42 which depends downwardly and inwardly; i.e., toward the inner wall 32. The angle of the wiper appendage 42 is about 200 but this angle is not deemed critical so long as the appendage curves or angles inwardly toward the inner wall 34 and not outwardly toward the skirt wall 26. A practical lower limit would be about 15.degree. The appendage 42 also includes a terminal end 43.

The appendage 42 is thicker at the base or root; i.e., where it integrally joins the top wall 36, than it is at the distal end as shown in FIG. 4. The appendage 42 also has a length of about 0.170" which is less than the distance between the inside surface of the top wall 36 and the ledge 38. The distance between the inside surface of the top wall 36 and the ledge 38 is also slightly greater than the distance between the top surface and the undersurface of the pail rim 15 so as to provide the slight clearance shown in FIG. 6. The ratio of the root thickness to the length of the appendage 42 is approximately 4.25:1. The overall length of the appendage 42 will depend on the size of the closure but is approximately 0.170" for a closure that fits a standard five-gallon molded HDPE container with an 11.5" diameter.

FIG. 6 shows the pail sidewall 14 with the top rim portion 15 essentially fully inserted into the U-shaped channel between the walls 26 and 32. i.e., inserted sufficiently far to seat the undersurface of the pail rim onto the top surface of the ledge 38 on the interior of the closure skirt portion 26, thereby essentially locking the closure 10 on to the pail rim 12. In this condition the inside surface pail sidewall fully contacts the ribs 40 to provide a primary seal therebetween. Furthermore, the top surface 21 of the rim 15 deflects the sealing wiper appendage 42 inwardly, creating more annular surface area of contact with the surface of the rim 14 thus providing an additional seal.

In the illustrative embodiment, a top surface 45 of the annular ledge 38 defines a ledge plane 47 as shown in FIG. 3. Each annular sealing ridge 40 of the plurality of sealing ridges 40 includes a tip 51, and the tip 51 of a lowermost annular sealing ridge 40 is located below the ledge plane 47. In some embodiments, the tip 51 of an uppermost annular sealing ridge 40 is located below the terminal end 43 of the sealing wiper appendage 42 in response to the sealing wiper appendage 42 being in the first position. In some embodiments, an uppermost point at which the uppermost annular sealing ridge 40 meets the radially outwardly facing surface 37 of the inner annular wall 32 is located equidistant from the interior facing surface 41 of the top annular wall 36 as the terminal end 43 of the sealing wiper appendage 42 in response to the sealing wiper appendage 42 being in the first position.

In the illustrative embodiment, a distance between the tip 51 of each annular sealing ridge 40 and the radially outwardly facing surface 37 of the inner annular wall 32 is 0.24 inches as shown in FIG. 3. In some embodiments, the plurality of annular sealing ridges 40 includes exactly two ridges 40, and the ledge plane 47 extends between the tips 51 of the two ridges 40. In some embodiments, the annular sealing ridges 40 are formed on a substantially vertical portion 53 of the radially outwardly facing surface 37 of the inner annular wall 32 to lie sealingly against the radially inwardly facing surface 25 of the inner annular container wall 24 to form the primary seal. The sealing wiper appendage 42 contacts the substantially vertical portion 53 of the radially outwardly facing surface 37 of the inner annular wall 32 in response to the sealing wiper appendage 42 being in the second position as shown in FIG. 6. The top rim portion 15 includes a substantially flat top surface 21 and the interior facing surface 41 of the top wall 36 is substantially flat so as to be parallel with the flat top surface 21 of the top rim 15.

In use, the pail and closure are shipped to the retailer unattached. The retailer fills the pail and firmly attaches the closure to the pail to complete the seal. Filled pails can be stacked to a degree depending on the design strength of the pail and closure, and the weight of the pail contents. The end user opens the pail by removing the tear strip. The closure can be reapplied to preserve unused content as needed.

It is to be understood that while the invention has been described in this document with respect to a specific but illustrative embodiment, various configurational and size changes may be made within the scope of the invention described and claimed herein. The drawings, although not fully dimensioned, are to scale.

The invention claimed is:

1. A container package comprising:

a container including an annular sidewall having an inner annular container wall with a top annular edge, a top rim extending radially outwardly from the top annular edge, and a downwardly extending container wall extending downwardly away from a radially outer end of the top rim; and a lock-on closure configured to couple to the container in a fixed position relative to the container, the lock-on closure including:

a plastic body including a center deck and an annular peripheral channel portion arranged radially outward of and integrally with the center deck, the annular peripheral channel portion including an inner annular wall, an outer annular wall radially spaced apart from the inner annular wall, and a top annular wall extending between and interconnecting top edges of the inner annular wall and the outer annular wall so as to define an inverted annular U-shaped channel configured to receive lockingly the top rim of the annular sidewall of the container, the downwardly extending container wall, and a portion of the inner annular container sidewall in a plug fit, the outer annular wall having an annular ledge extending radially inwardly away from a radially inwardly facing surface of the outer annular wall and configured to abut lockingly an under surface of the downwardly extending container wall in response to the annular sidewall of the container being fully inserted into the inverted annular U-shaped channel, wherein a radially outwardly facing surface of the inner annular wall includes a primary seal for cooperation with a radially inwardly facing surface of the inner annular container wall, the primary seal including a plurality of annular sealing ridges formed on the radially outwardly facing surface of the inner annular wall to lie sealingly against the radially inwardly facing surface of the inner annular container wall to form the primary seal; and a single, flexible sealing wiper appendage extending away from an interior facing surface of the top annular wall of the annular peripheral channel portion, wherein, in response to the annular sidewall of the container being outside of the inverted annular U-shaped channel, the sealing wiper appendage is in a first position in which the sealing wiper appendage extends downwardly from the interior facing surface of the top annular wall and is angled radially inwardly toward the inner annular wall of the annular peripheral channel portion and the primary seal such that a terminal end of the sealing wiper appendage is freely suspended within the inverted annular U-shaped channel, wherein, in response to the annular sidewall of the container being fully inserted into the inverted annular U-shaped channel, the sealing wiper appendage is in a second position in which the terminal end is closer to the inner annular wall than in the first position, in which the terminal end of the sealing wiper appendage contacts the inner annular wall, and in which the sealing wiper appendage contacts a top outer surface of the top rim to form a secondary seal with the container which secondary seal reacts to pressure within the container to increase in sealing effect, and wherein, in response to the annular sidewall of the container being fully inserted into the inverted annular U-shaped channel and the sealing wiper appendage being in the second position, the interior facing surface of the top annular wall is entirely spaced apart from the top outer surface of the top rim.

2. The container package of claim 1, wherein the entirety of the lock-on closure is molded from high density polyethylene (HDPE).

3. The container package of claim 1, wherein the sealing wiper appendage has a root and a length, wherein the ratio of the length dimension to the root dimension is approximately 4.25:1, wherein the sealing wiper appendage includes a radially outer surface having a generally flat shape and a radially inner surface having a generally flat shape opposite the outer surface, each of the radially outer and inner surface depending downwardly towards the tip of the sealing wiper appendage, and wherein, when the rim is not inserted into said annular channel and when the rim is fully inserted into said annular channel, the radially outer and inner surfaces retain the generally flat shape.

4. The container package of claim 3, wherein the length of the sealing wiper appendage is about 0.170 inches.

5. The container package of claim 1, wherein the sealing wiper appendage angles radially inwardly toward the inner annular wall by about 20° in the first position.

6. The container package of claim 1, wherein a top surface of the annular ledge defines a ledge plane, wherein each annular sealing ridge of the plurality of sealing ridges includes a tip, and wherein the tip of a lowermost annular sealing ridge of the plurality of annular sealing ridges is located below the ledge plane.

7. The container package of claim 6, wherein the tip of an uppermost annular sealing ridge of the plurality of annular sealing ridges is located below the terminal end of the sealing wiper appendage in response to the sealing wiper appendage being in the first position.

8. The container package of claim 7, wherein an uppermost point at which the uppermost annular sealing ridge meets the radially outwardly facing surface of the inner annular wall is located equidistant from the interior facing surface of the top annular wall as the terminal end of the sealing wiper appendage in response to the sealing wiper appendage being in the first position.

9. The container package of claim 6, wherein a distance between the tip of each annular sealing ridge of the plurality of annular sealing ridges and the radially outwardly facing surface of the inner annular wall is 0.24 inches.

10. The container package of claim 6, wherein the plurality of annular sealing ridges includes exactly two ridges, and wherein the ledge plane extends between the tips of the two ridges.

11. The container package of claim 1, wherein the plurality of annular sealing ridges are formed on a substantially vertical portion of the radially outwardly facing surface of the inner annular wall to lie sealingly against the radially inwardly facing surface of the inner annular container wall to form the primary seal, and wherein the sealing wiper appendage contacts the substantially vertical portion of the radially outwardly facing surface of the inner annular wall in response to the sealing wiper appendage being in the second position.

12. The container package of claim 1, wherein the top rim includes a substantially flat top surface and the interior facing surface of the top annular wall is substantially flat so as to be parallel with the flat top surface of the top rim, and wherein the interior facing surface is divided into an inner half that is closer to the inner annular wall than the outer annular wall and an outer half opposite the inner half.

13. A container package comprising:

a container including an annular sidewall having an annular container wall, a top rim extending from the annular container wall, and a downwardly extending container wall extending downwardly away from the top rim; and a lock-on closure configured to couple to the container in a fixed position relative to the container, the lock-on closure including:

a body including a channel portion including an inner annular wall, an outer annular wall, and a top annular wall extending between and interconnecting the inner annular wall and the outer annular wall so as to form a channel, wherein the inner annular wall includes a primary seal for cooperation with the annular container wall, the primary seal including a plurality of annular sealing ridges to lie sealingly against the inner annular container wall to form the primary seal, wherein the outer annular wall defines an upper inwardly facing surface defined between an annular ledge and the top annular wall, wherein a majority of the upper inwardly facing surface of the outer annular wall is configured to contact an outwardly facing surface of the top rim when the top rim is fully inserted into the channel; and a single, flexible sealing wiper appendage extending away from the top annular wall of the channel portion, wherein, in response to the annular sidewall of the container being outside of the channel, the sealing wiper appendage is in a first position in which the sealing wiper appendage extends downwardly from the top annular wall and is angled inwardly toward the inner annular wall and the primary seal such that a terminal end of the sealing wiper appendage is freely suspended within the channel, wherein, in response to the annular sidewall of the container being fully inserted into the channel, the sealing wiper appendage is in a second position in which the terminal end contacts the inner annular wall and in which the sealing wiper appendage contacts a top outer surface of the top rim to form a secondary seal with the container, and wherein, in response to the annular sidewall of the container being fully inserted into the inverted annular U-shaped channel and the sealing wiper appendage being in the second position, the lock-on closure is entirely spaced apart from an entirety of the top outer surface of the top rim.

14. The container package of claim 13, wherein the tip of an uppermost annular sealing ridge of the plurality of annular sealing ridges is located below the terminal end of the sealing wiper appendage in response to the sealing wiper appendage being in the first position.

15. The container package of claim 14, wherein an uppermost point at which the uppermost annular sealing ridge meets the inner annular wall is located equidistant from the interior facing surface of the top annular wall as the terminal end of the sealing wiper appendage in response to the sealing wiper appendage being in the first position.

16. The container package of claim 13, wherein the sealing wiper appendage angles radially inwardly toward the inner annular wall by about 20° in the first position.

17. The container package of claim 13, wherein a distance between the tip of each annular sealing ridge of the plurality of annular sealing ridges and the inner annular wall is 0.24 inches.

18. The container package of claim 13, wherein the top rim includes a substantially flat top surface and the interior facing surface of the top annular wall is substantially flat so as to be parallel with the flat top surface of the top rim, and wherein the interior facing surface is divided into an inner half that is closer to the inner annular wall than the outer annular wall and an outer half opposite the inner half.

19. The container package of claim 13, wherein the plurality of annular sealing ridges includes exactly two ridges, and wherein the ledge plane extends between the tips of the two ridges.

20. A method, comprising:

providing a container including an annular sidewall having an inner annular container wall with a top annular edge, a top rim extending radially outwardly from the top annular edge, and a downwardly extending container wall extending downwardly away from a radially outer end of the top rim;

providing a lock-on closure for the container, the lock-on closure including a plastic body including a center deck and an annular peripheral channel portion arranged radially outward of and integrally with the center deck, the annular peripheral channel portion including an inner annular wall, an outer annular wall radially spaced apart from the inner annular wall, and a top annular wall extending between and interconnecting top edges of the inner annular wall and the outer annular wall so as to define an inverted annular U-shaped channel configured to receive lockingly the top rim of the annular sidewall of the container, the downwardly extending container wall, and a portion of the inner annular container sidewall in a plug fit;

arranging an annular ledge on the outer annular wall, the annular ledge extending radially inwardly away from a radially inwardly facing surface of the outer annular wall and configured to abut lockingly an under surface of the downwardly extending container wall in response to the annular sidewall of the container being fully inserted into the inverted annular U-shaped channel, wherein the outer annular wall defines an upper inwardly facing surface defined between the annular ledge and the top annular wall, wherein a majority of the upper inwardly facing surface of the outer annular wall is configured to contact an outwardly facing surface of the top rim when the top rim is fully inserted into the channel;

arranging a primary seal including a plurality of annular sealing ridges on a radially outwardly facing surface of the inner annular wall to lie sealingly against a radially inwardly facing surface of the inner annular container wall to form the primary seal;

arranging a single, flexible sealing wiper appendage extending away from an interior facing surface of the top annular wall of the annular peripheral channel portion, wherein, in response to the annular sidewall of the container being outside of the inverted annular U-shaped channel, the sealing wiper appendage is in a first position in which the sealing wiper appendage extends downwardly from the interior facing surface of the top annular wall and is angled radially inwardly toward the inner annular wall of the annular peripheral channel portion and the primary seal such that a terminal end of the sealing wiper appendage is freely suspended within the inverted annular U-shaped channel; and inserting fully the annular sidewall of the container into the inverted annular U-shaped channel such that the annular ledge lockingly abuts an under surface of the outer side wall and such that the sealing wiper appendage moves to a second position in which the terminal end contacts the inner annular wall and in which the sealing wiper appendage contacts a top outer surface of the top rim to form a secondary seal with the container which secondary seal reacts to pressure within the container to increase in sealing effect, wherein, in response to the annular sidewall of the container being fully inserted into the inverted annular U-shaped channel and the sealing wiper appendage being in the second position, the lock-on closure is entirely spaced apart from an entirety of the top outer surface of the top rim.

21. The container package of claim 1, wherein the outer annular wall defines an upper inwardly facing surface defined between the annular ledge and the top annular wall, and wherein a majority of the upper inwardly facing surface of the outer annular wall is configured to contact an outwardly facing surface of the top rim when the top rim is fully inserted into the channel.

* * * * *